US005460150A

United States Patent [19]

Joppe

[11] Patent Number: 5,460,150

[45] Date of Patent: Oct. 24, 1995

[54] REPEATING ELASTIC BAND SHOOTING GUN

[76] Inventor: Brent Joppe, 6976 Goldmine Rd., Morganton, N.C. 28655

[21] Appl. No.: 315,978

[22] Filed: Sep. 30, 1994

[51] Int. Cl.[6] ..... F41B 7/02

[52] U.S. Cl. ..... 124/19; 124/48

[58] Field of Search ..... 124/19, 18, 17, 124/20.1, 20.2, 21, 48, 35.1, 41.1

[56] References Cited

U.S. PATENT DOCUMENTS

| | | | |
|---|---|---|---|
| 2,001,267 | 5/1935 | Ross | 124/48 X |
| 3,515,387 | 6/1970 | House | 124/19 X |
| 3,693,609 | 9/1972 | Vodinh | 124/19 |
| 3,757,760 | 9/1973 | Darnell | 124/19 |
| 4,676,219 | 6/1987 | Miller | 124/19 |
| 4,800,864 | 1/1989 | Small | 124/19 |
| 5,222,472 | 6/1993 | Landingham | 124/19 |

*Primary Examiner*—Eric K. Nicholson
*Assistant Examiner*—Harry C. Kim
*Attorney, Agent, or Firm*—Carter & Schnedler

[57] ABSTRACT

There is provided a gun for shooting a plurality of elastic bands in a repeating fashion. The gun includes a frame and a grip. A magazine which holds a plurality of stretched elastic bands is rotatably mounted on an elongated spindle which extends from the frame. The magazine includes a plurality of upwardly-extending lands which are proximal to the frame and a plurality of corresponding outwardly-extending posts which are distal to the frame. Each land and its corresponding post receive an elastic band in its stretched condition. A rotatable string containing a spool is connected to the frame. Portions of the string extending from the spool are received between each of the lands and the elastic bands so that the elastic bands are released by the upward movement of the string as the string is retrieved onto the spool.

10 Claims, 3 Drawing Sheets

REPEATING ELASTIC BAND SHOOTING GUN

BACKGROUND OF THE INVENTION

This invention relates to elastic band shooting guns. More particularly, it relates to guns which shoot elastic bands in a repeating fashion.

Children have for many years shot rubber bands with their hands and fingers by placing one end of a stretched rubber band on the end of their index finger, bending the rubber band about an outstretched thumb, and securing the other end of the rubber band to an outstretched pinkie finger. The rubber band is released by the retraction of the pinkie finger.

More recently, rubber band firing toy guns have been developed which fire a plurality of rubber bands in a repeating fashion. A repeating gun pistol is described in U.S. Pat. No. 4,676,219 issued to Miller. The Miller pistol includes a pistol grip having a spindle extending therefrom. A magazine having a plurality of elongated arms circumferentially mounted thereon is rotatably mounted on the spindle. A string which is received on a second rotating spindle is attached to a rubber band which, in turn, is received over the ends of one of the arms on the magazine. A portion of the string is then payed out the second spindle and is wrapped about the remaining arms of the magazine. Additional rubber bands are then placed over the other arms of the magazine. Upon the reeling of the string back onto the second spindle, the rubber bands are released due to the upward movement of the string.

The pistol described in the Miller patent suffers from numerous drawbacks, some of which are set forth below:

1. The rubber band receiving ends of each of the arms are at the same level so that the gun tends to shoot high;
2. Because the string is attached to a rubber band and is, in turn, wrapped about the cylinder at virtually any position along the cylinder, there is no assurance that the rubber bands will fire in a forward direction, i.e. the rubber bands could backfire, injuring the shooter;
3. The magazine is not permanently affixed to the remainder of the gun so that the magazine may easily fall off or be misplaced;
4. The distal end of the magazine does not positively secure the rubber bands thereto, so that the rubber bands are difficult to load, and may again misfire in the direction towards the shooter; and
5. The pistol is difficult to load and is cumbersome to operate.

Thus, there is a need for an improved repeating elastic band shooting gun.

OBJECTS OF THE INVENTION

It is therefore one object of the invention to provide an improved repeating elastic band shooting gun.

It is another object of this invention to provide a repeating elastic band shooting gun which is easy to operate.

It is still another object to provide a repeating elastic band shooting gun which will not backfire.

It is yet another object of this invention to provide a repeating elastic band shooting gun which is accurate.

It is a further object of this invention to provide a repeating elastic band shooting gun which is easy to load.

SUMMARY OF THE INVENTION

In accordance with one form of this invention there is provided a gun for shooting a plurality of elastic bands in a repeating fashion, including a frame having a grip. A magazine is provided for holding the plurality of elastic bands. An elongated spindle extends from the frame. The magazine is mounted on the spindle so that it may freely rotate about the spindle. The magazine includes a plurality of upwardly extending lands located proximal to the frame, and a plurality of outwardly extending posts located distal to the frame. Each land is substantially in alignment with a corresponding post so that an elastic band may be secured to the magazine in a stretched condition by a land and its corresponding post. A rotatable spool is connected to the frame. The spool contains a string. One end of the string extends from the spool. Portions of the string are adapted to be received between each of the lands and the elastic bands mounted on the lands, whereby the elastic bands are released due to the movement of the string.

It is preferred that the lands and posts are arranged in circles with the outside diameter of the circle formed by the plurality of lands being greater than the outside diameter of the circle formed by the posts, so that greater accuracy is achieved by the gun.

In addition, it is preferred that there is plate near the distal end of the magazine with the post extending through the plate so that the elastic bands are readily secured to the posts and rest against the surface of the plate to make it easy to load the gun and to eliminate misfiring in the direction of the shooter.

It is also preferred that the string be permanently affixed to the magazine and that the magazine be permanently affixed to the frame.

BRIEF DESCRIPTION OF THE DRAWINGS

The subject matter which is regarded as the invention is set forth in the appended claims. The invention, itself, however, together with further objects and advantages thereof, may be better understood by reference to the following description, taken in conjunction with the accompanying drawings, in which:

DESCRIPTION OF THE PREFERRED EMBODIMENT

Figure 1:
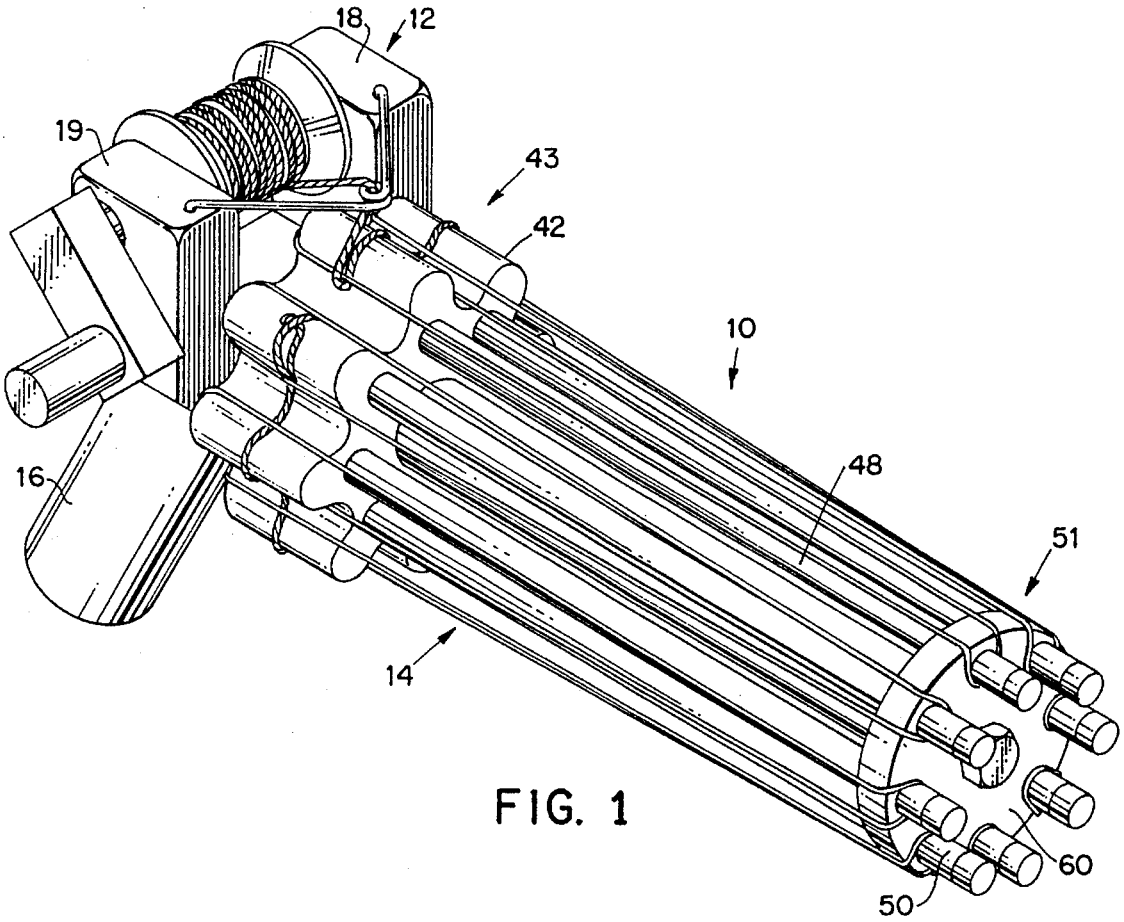
FIG. 1 is a pictorial view showing the apparatus of the subject invention.

Referring now more particularly to FIGS. 1 through 7, there is provided a gun 10, including a frame 12 and magazine 14. Gun 10 is in the form of a pistol. However, the invention is equally applicable to other forms of guns, such as rifles.

Frame 12 includes grip 16, extending below a pair of upwardly extending support arms 18 and 19. The support arms 18 and 19 are connected together by base 20.

Holes 22 and 24 extend through arms 18 and 19, respectively, and receive spindle 26. Spool 28 is mounted on spindle 26 and receives string 30.

Hand crank 32 is attached to spindle 26 for rotating the spool. Preferably the spool is glued to the spindle 26, so that the spool will not rotate about the spindle.

Eyelet 33 is attached to arms 18 and 19, and includes an opening 34 for receiving and guiding string 30.

Magazine 14 is rotatably attached to base 20 through spindle 36. Spindle 36 is covered by elongated hollow tube 38. Both spindle 36 and hollow tube 38 extend the entire length of the magazine 14.

Screw 40 is attached to spindle 36 and secures the magazine 14 to the frame 12. Magazine 14 includes cylindrically shaped member 42, which includes a plurality of circumferentially spaced apart lands 44, and a plurality of circumferentially spaced apart grooves 46. There is a groove 46 between each land 44.

The magazine 14 also includes a plurality of elongated rods 48 which extend through plate 54 in a circular arrangement. Preferably, the rods are in the form of brightly colored pencils which are inexpensive and enhance the appearance of the gun.

The ends of the rods 48 extend through holes 52 in plate 54 forming posts 50. If pencils are used as the rods, the posts 50 include the eraser ends of the pencils. Plate 54 is located near the distal end 51 of the magazine 14, while the circular shaped member 42 is located near the proximal end 43 of the magazine. The end 39 of hollow cylinder 38 abuts against the inside surface of plate 54.

Figure 2:
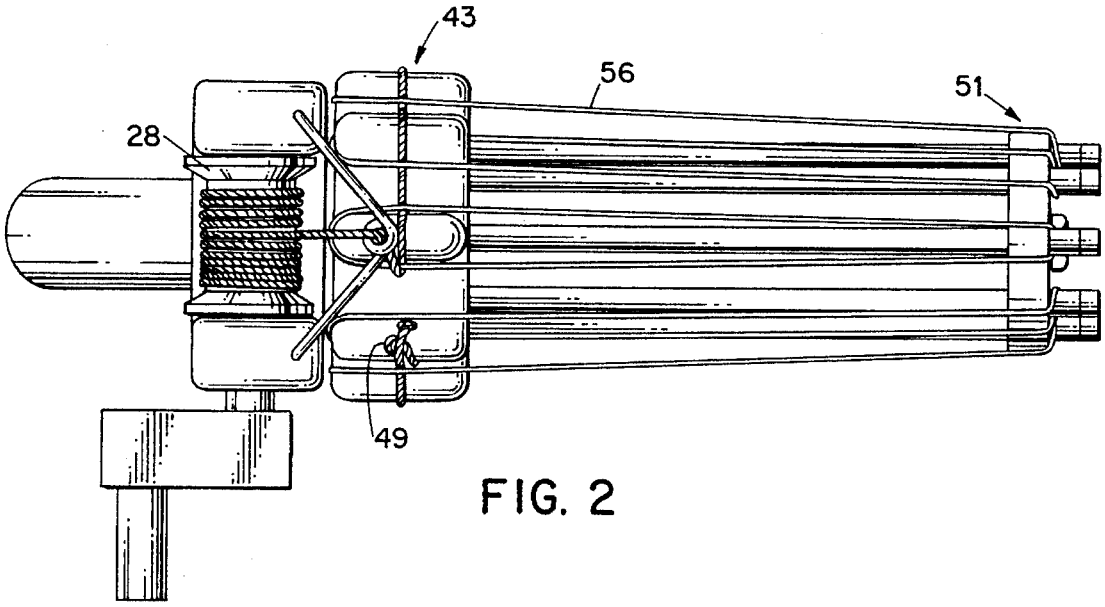
FIG. 2 is a top view of the apparatus of FIG. 1.
Figure 3:
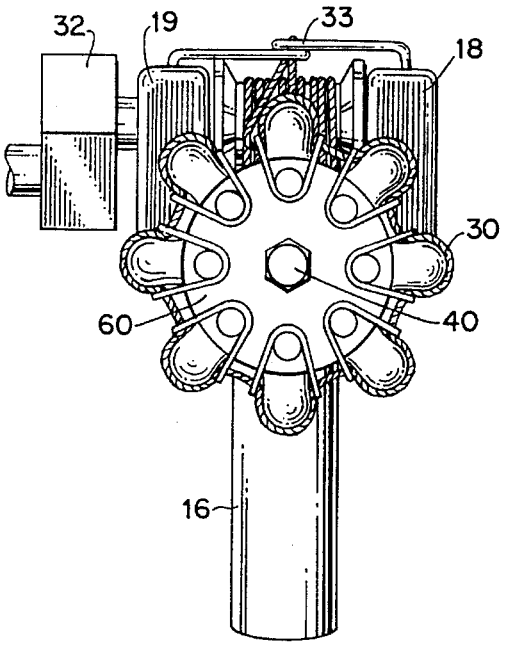
FIG. 3 is a front elevational view of the apparatus of FIG. 1.
Figure 6:
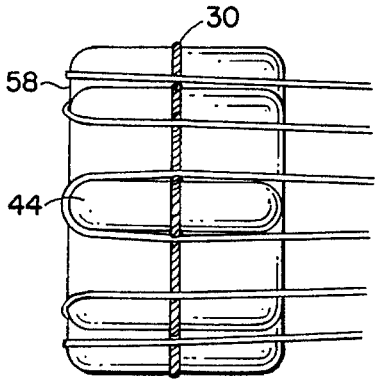
FIG. 6 is a side elevational view, showing a portion of the apparatus of FIG. 4.
Figure 4:
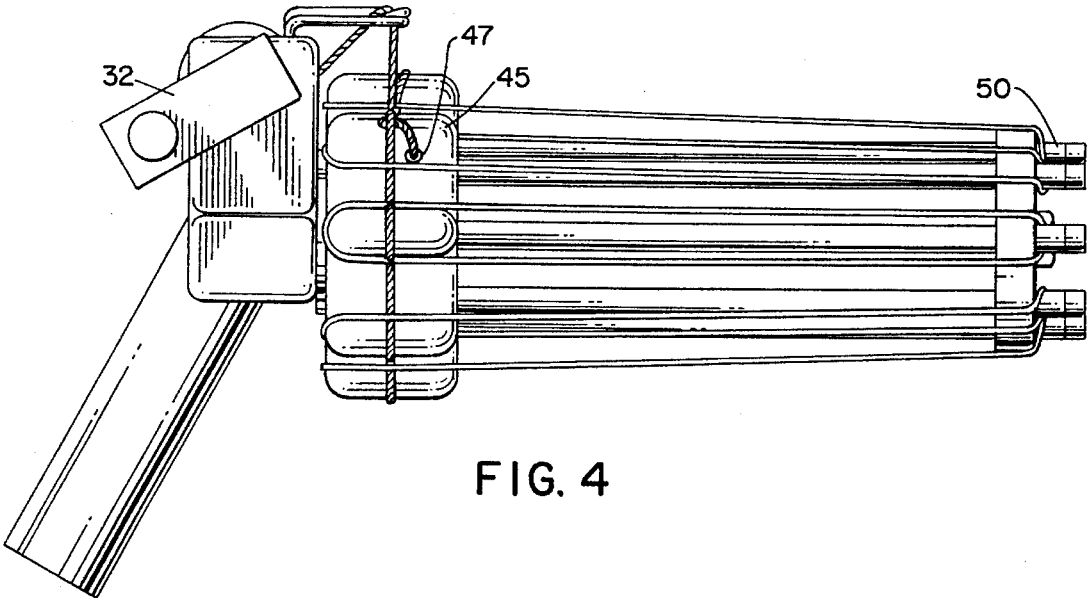
FIG. 4 is a side elevational view of the apparatus of FIG. 1.
Figure 5:
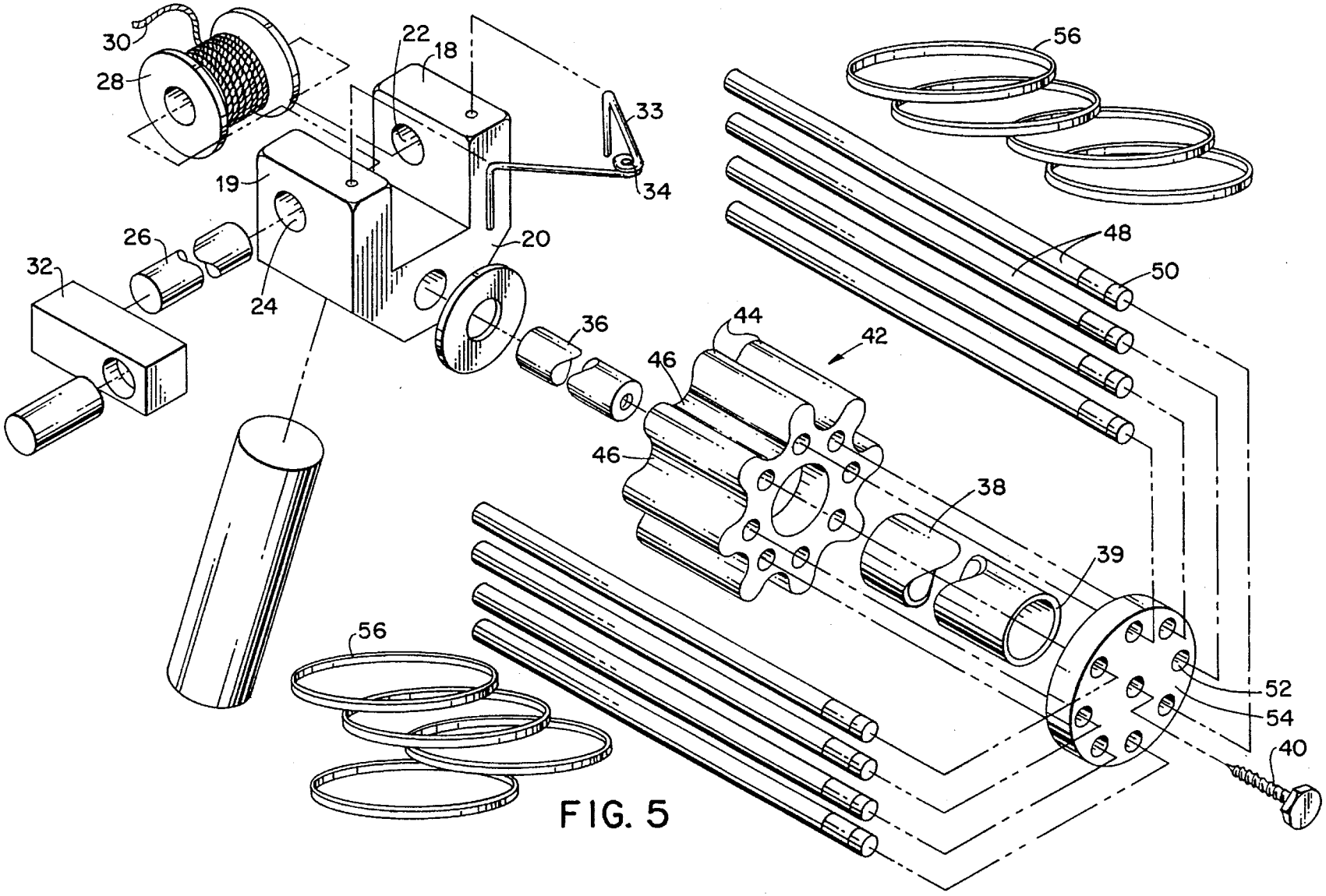
FIG. 5 is an exploded view of the apparatus of FIG. 1.

Land 45, as shown in FIGS. 2 and 4, includes a first hole 47 therethrough and a second hole 49 in the top thereof. String 30 is attached to land 45 by placement of its free end through hole 47 and into hole 49. Preferably, the free end of the string is glued into hole 49 or it may be tied to the land 45, with hole 49 being eliminated.

Preferably, the outside diameter of the cylindrical shaped member 43, that is, from the top of one land to the top of another land of 180° on the opposite side of the cylindrical shaped member, is greater than the outside diameter of the circle formed by the posts 50 at the distal end of the magazine. This uneven arrangement enables the gun to shoot straighter. If the outside diameters of the circle formed by the posts and the cylindrical shaped member were substantially identical, it has been shown that the gun will shoot high because of the upward momentum of the elastic band as it leaves the land 44. It is preferred that the outside diameter of said cylindrical shaped member is at least 5% greater than the outside diameter of the circle formed by said posts.

Elastic bands 56 are secured to the magazine by posts 50 and by the lands 44. However, prior to mounting the elastic bands on the magazine, string 30 is wrapped around the cylindrical shaped member 43 by simply rotating the magazine so that the reel 28 will pay out the string 30. Once the string completely circumscribes the cylindrical shaped member 43, the elastic bands 56 are stretched onto the lands and around the posts. One end of each elastic band rests against the back side 58 of each land, while the other end is received about each post 50, and rests against the outside surface 60 of plate 54.

Figure 7:
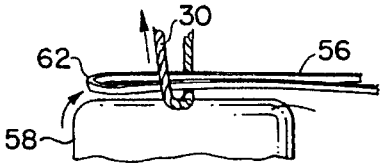
FIG. 7 shows a portion of one of the lands of FIG. 6, illustrating the elastic band release mechanism.

When it is desired to shoot the fully loaded gun, handle 32 is rotated in a direction so that the reel 28 takes up string 30 and, with the eyelet guiding the string, the string will lift upwardly on each successive land, as the magazine is rotated, which rotation is caused by the force of the string as the string is taken up by the spool. As the string is lifted, as illustrated in FIG. 7, each end 62 of elastic band 56 is lifted over the end 58 of land 44, and is released in the forward direction. This will continue until all the elastic bands have been released in a repeating fashion.

One may load several rounds of elastic bands for each post/land combination by simply rotating the magazine, again in the pay out direction of the string so that the string circumscribes the cylindrically shaped member 43 for a second time, and then placing a second elastic band on each of the land/post combinations. This may be continued for additional rounds with the major limitations being the amount of string on the reel and the space provided at the end 58 of each land, and the length of post 50.

Because the release action always takes place near the distal end of the magazine, and because of the use of the post 50 to secure the elastic bands at the distal end, it is virtually impossible for this gun to backfire. In addition, with the string permanently attached to the magazine, and with the magazine permanently attached to the frame, the gun is very easy to operate, and is particularly very easy to load. Also, because of the high release angle, the gun is very accurate.

From the foregoing description of the preferred embodiment of the invention, it will be apparent that many modifications may be made therein. It will be understood, therefore, that this embodiment of the invention is intended as an exemplification of the invention only, and that the invention is not limited thereto. It is be understood therefore that it is intended in the appended claims to cover all modifications as fall within the true spirit and scope of the invention.

I claim:

1. A gun for shooting a plurality of elastic bands in a repeating fashion, comprising:

a frame including a grip;

a magazine for holding the plurality of elastic bands;

an elongated spindle extending from said frame; said magazine mounted on said spindle, wherein said magazine may fully rotate about said spindle; said magazine including a cylindrically shaped member; said cylindrically shaped member including a plurality of radially extending lands located proximal to said frame, and a plurality of rods connected to said cylindrically shaped member to form a plurality of outwardly extending posts located distal to said frame;

each land substantially aligned with a corresponding post, wherein each elastic band may be secured to said magazine in a stretched condition by one of said lands and its corresponding post; and a rotatable spool connected to said frame; said spool containing string; one end of said string extending from said spool; portions of said string adapted to be received between each of said lands and said elastic bands whereby said elastic bands are released by the movement of said string.

2. A gun as set forth in claim 1, wherein said lands and said posts form circles about said magazine; the outside of said circle formed by said plurality of lands being greater than the outside diameter of said circle formed by said plurality of posts.

3. A gun as set forth in claim 2, wherein the outside diameter of said circle formed by said plurality of lands is at least five percent greater than the outside diameter of said circle formed by plurality of said posts.

4. A gun as set forth in claim 1, further including a plate mounted to said spindle near said distal end of said magazine; said posts extending from said plate, wherein portions of said elastic bands loop around said posts and rest against a surface of said plate so that the elastic bands are readily secured so as to avoid backfiring.

5. A gun as set forth in claim 1, wherein said string is permanently attached to said magazine near Said proximal end of said magazine.

6. A gun as set forth in claim 5, wherein said lands are formed on said cylindrically shaped member; said cylindrically shaped member including a groove located between each said land; said string attached to said member.

7. A gun as set forth in claim 5, wherein a hole is received in one of said lands; said string received in said hole for securing said string to said cylindrically shaped member.

8. A gun as set forth in claim 6, further including an eyelet connected to said frame; said eyelet receiving said string and being located above said cylindrically shaped member for guiding said string between said spool and said cylindrically shaped member.

9. A gun as set forth in claim 6, wherein said posts are mounted to and extending away from said cylindrically shaped member; a plate located near the distal end of said magazine; said posts extending through said plate.

10. A gun for shooting a plurality of elastic bands in a repeating fashion, comprising:

a frame including a grip;

a magazine for holding a plurality of elastic bands;

an elongated spindle extending through said frame;

said magazine mounted on said spindle, wherein said magazine may freely rotate about said spindle;

said magazine including a cylindrically shaped member located proximal to said frame;

said cylindrically shaped member including a plurality of radially extending lands and a plurality of grooves; each groove being located between each adjacent land;

a plurality of rods connected to said cylindrically shaped member;

a plate located distal to said frame; the ends of said rods being received in a cylindrical fashion through said plate, thereby forming posts; each land substantially aligned with a corresponding post, wherein each elastic band may be secured to said magazine in a stretched condition by one of said lands and its corresponding post;

a rotatable spool connected to the frame; said spool containing a string; one end of said string extending from said spool; portions of said string adapted to be received between said each land and said elastic band mounted on said each land, whereby the elastic bands are released by the upward movement of said string, which movement is caused by said spool taking up said string;

the outside diameter of said cylindrically shaped member being greater than the outside diameter of the circle formed by said plurality of said posts extending through said plate.

* * * * *